United States Patent [19]

Min

[11] Patent Number: 4,989,692

[45] Date of Patent: Feb. 5, 1991

[54] MULTI-PURPOSE EXTENDABLE & RETRACTABLE LADDER

[76] Inventor: Liaw S. Min, No. 3, Alley 25, Lane 194, Chung-Hsiao Road, Ping Tenn, Hsiang, Tao-Yuan, Hsien, Taiwan

[21] Appl. No.: 367,193

[22] Filed: Jun. 16, 1989

[51] Int. Cl.[5] ..... E06C 1/12

[52] U.S. Cl. ..... 182/166; 182/24; 182/173; 182/195

[58] Field of Search ..... 182/166, 23, 24, 173, 182/176, 167, 22, 174, 195

[56] References Cited

U.S. PATENT DOCUMENTS 1,936,508 11/1933 Hanly et al. ..... 182/24

2,827,216 3/1958 Napolitano ..... 182/166 Y

*Primary Examiner*—Alvin C. Chin-Shue

[57] ABSTRACT

A ladder that includes two hinged sections that can be oriented in an inverted V-configuration for use as a step ladder, or in a straight linear configuration for use as a straight ladder. Each section of the ladder includes a number of U-shaped support units, each of which defines a crossbar and two downwardly extending side rails. The side rails of the different U-shaped units are of graduated cross sectional dimension, such that the units can be contracted together by telescopically sliding the aligned side rails within one another.

2 Claims, 12 Drawing Sheets

MULTI-PURPOSE EXTENDABLE & RETRACTABLE LADDER

BACKGROUND AND SUMMARY OF THE INVENTION

This invention relates to a step ladder that can either an inverted V-shaped configuration or an elongated straight configuration or an elongated straight configuration. In its inverted V-configuration the ladder can assume a free standing "step ladder" condition. In its straight configuration the ladder is extended or elongated for use in reaching elevated locations.

The ladder includes two hingedly-connected sections. Each section is comprised of a number of U-shaped units arranged for telescopic connection, one within another, such that the ladder sections can be folded and retracted into a compact package for each storage.

The U-shaped units that make up each ladder section comprise hollow cross bars that fit onto plastic end connectors or blocks. Tubular side rails fit into these connector blocks. Each side rail has a hollow plastic sleeve at its lower end. The various side rails and associated plastic elements are dimensioned so that the various side rails are of increased cross sectional area, measured from the upper U-shaped unit to the lower U-shaped unit. This feature enables the side rails of the various units to telescope into each other to form a compact assembly suitable for convenient storage.

A manually-operable latch mechanism is built into the cross bar of each U-shaped unit for holding the U-shaped units in their extended positions.

THE DRAWINGS

DESCRIPTION OF A PREFERRED EMBODIMENT OF THE INVENTION

Figure 1:
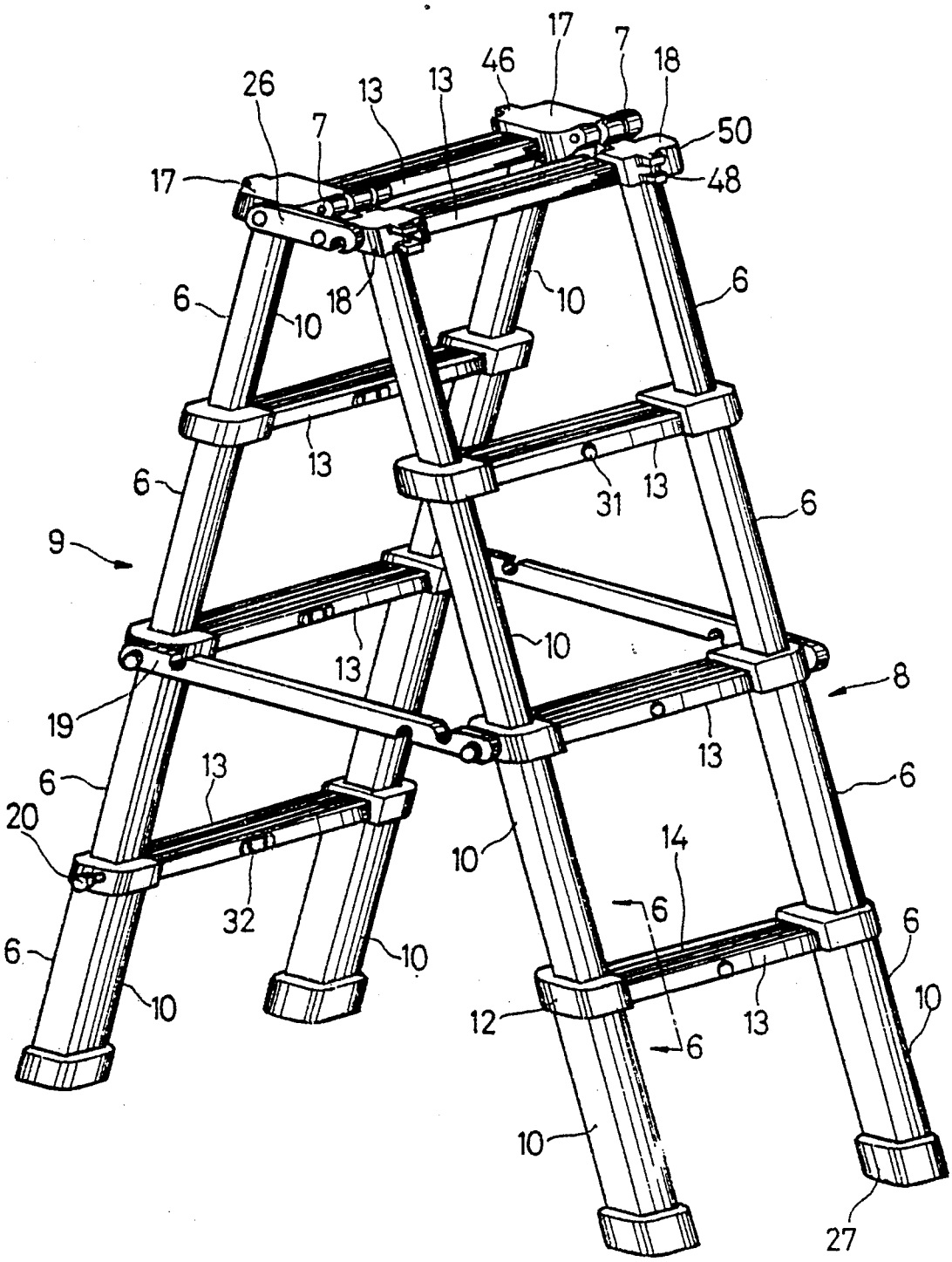
• FIG. 1 is a perspective view of a ladder constructed according to the invention.

The ladder shown in FIG. 1 comprises two upright ladder sections 8 and 9 arranged in an inverted V-shaped configuration. The upper ends of the ladder sections are hingedly interconnected by two hinge mechanisms 7, whereby the ladder sections can be unfolded to assume the straight ladder configuration shown in FIG. 2. Hinge mechanisms 7 are constructed to include special fastener devices for keeping the ladder sections in the straight configuration.

Figure 3:
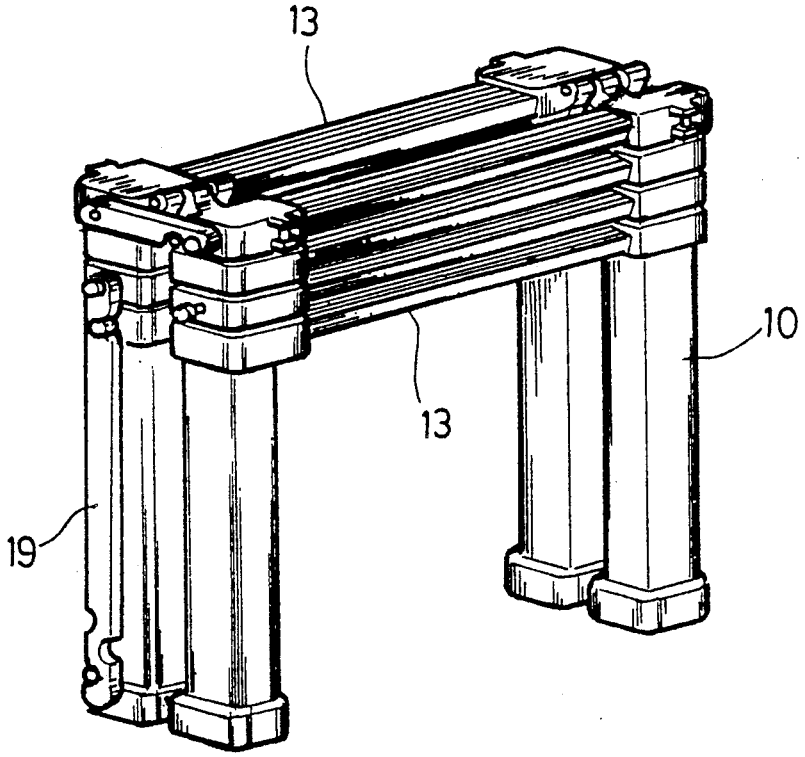
FIG. 3 is a perspective view taken in the same direction as FIG. 1, but showing the ladder in a folded and retracted condition suitable for storage.

As shown in FIG. 1, each ladder section 8 or 9 is comprised sof four U-shaped support units, designated generally by numerals 6. Each U-shaped unit comprises a crossbar 13 and two downwardlydepending side rails 10. The crossbars serve as steps (rungs) for the ladder. The side rails 10 are of graduated cross sectional dimensions such that a side rail on a given U-shaped side rail on a given U-shaped side rail can slidably telescope into the aligned side rail of the next lowermost unit. FIG. 3 shows the ladder in a folded and contracted condition so that the side rails of the U-shaped unsits are fully telescoped into one another.

Figure 6:
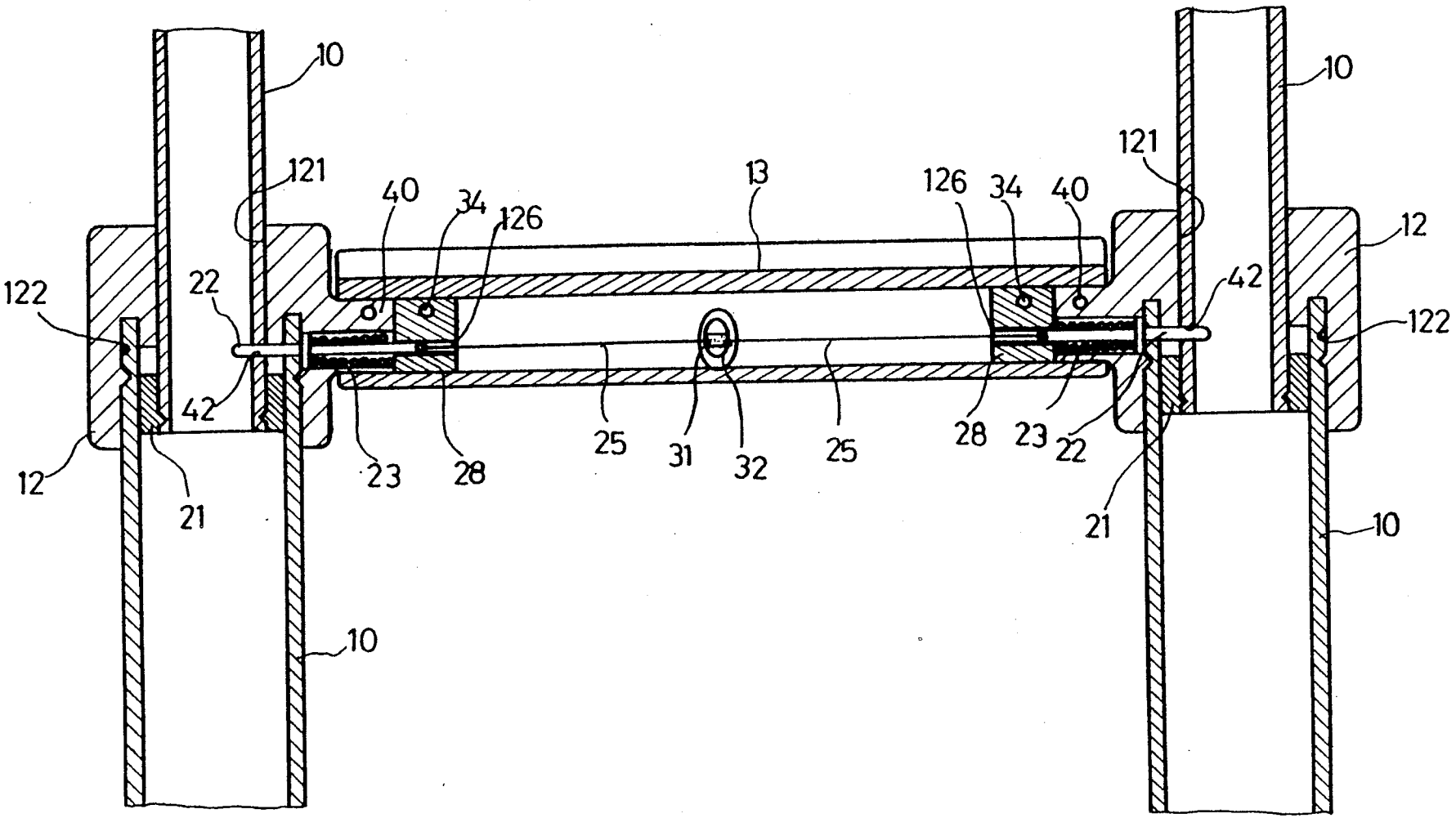
FIG. 6 is a fragmentary sectional view taken on line 6-6 in FIG. 1.
Figure 7:
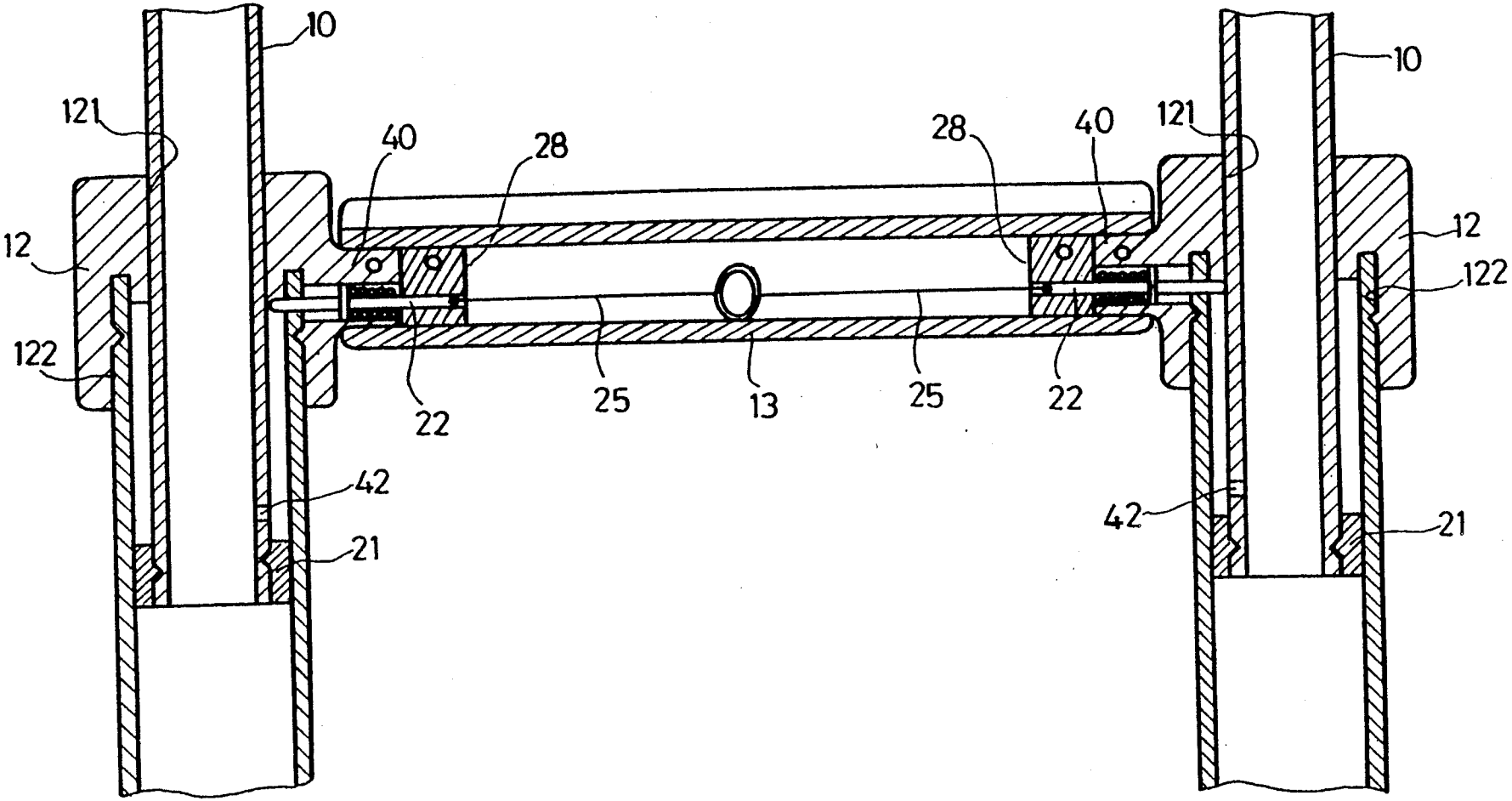
FIG. 7 is a view taken in the same direction as FIG. 6, but showing the components in a different condition of adjustment.
Figure 9:
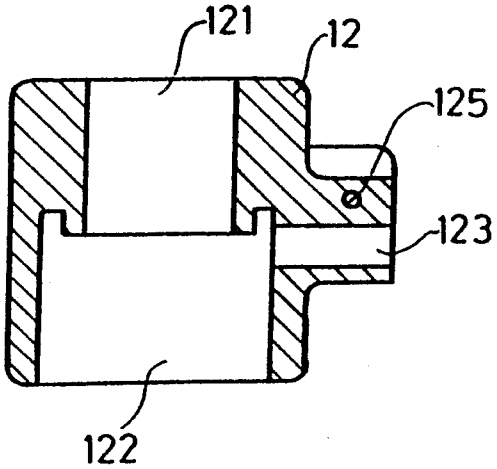
FIG. 9 is a sectional view taken through a connector block used in the FIG. 1 ladder.
Figure 11:
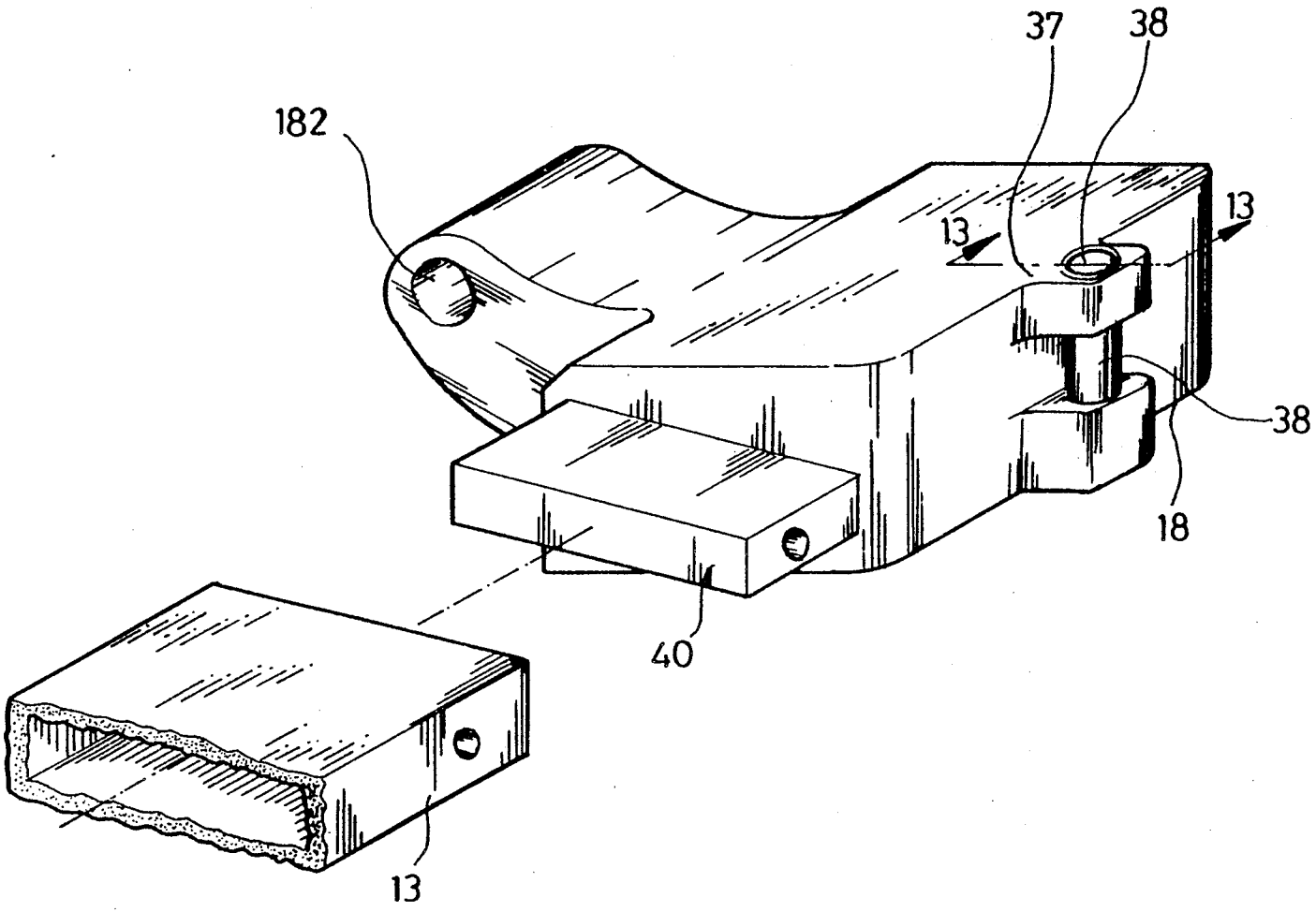
FIG. 11 is an exploded perspective view of a second hinge mechanism and crossbar used in the FIG. 1 ladder.

FIGS. 6 and 7 illustrate the general configuration of a representative U-shaped unit 6. The tubular side rails 10 have their upper ends extending into socket openings 122 in plastic connector blocks 12; FIG. 9 shows one of the connector blocks detached from the associated side rail 10.

Each connector block 12 has a laterally extending plug 40 inserted into an end of the associated crossbar 13. Pins may be extended through each plug 40 and the crossbar to form a rigid connection between connector block 12 and the crossbar. Each connector block 12 has a guide bore 121 extending upwardly from the associated socket opening 122. Each bore 121 is sized to slidably fit a side rail 10 of the next uppermost U-shaped unit 6. As shown in FIGS. 6 and 7, the side rail has a plastic sleeve 21 affixed thereto as a slidable fit in the side rail of the next lowermost U-shaped unit. The various guide bores 121 and plastic sleeves 21 form two-point slidable connections between the telescopically aligned side rails 10.

Figure 2:
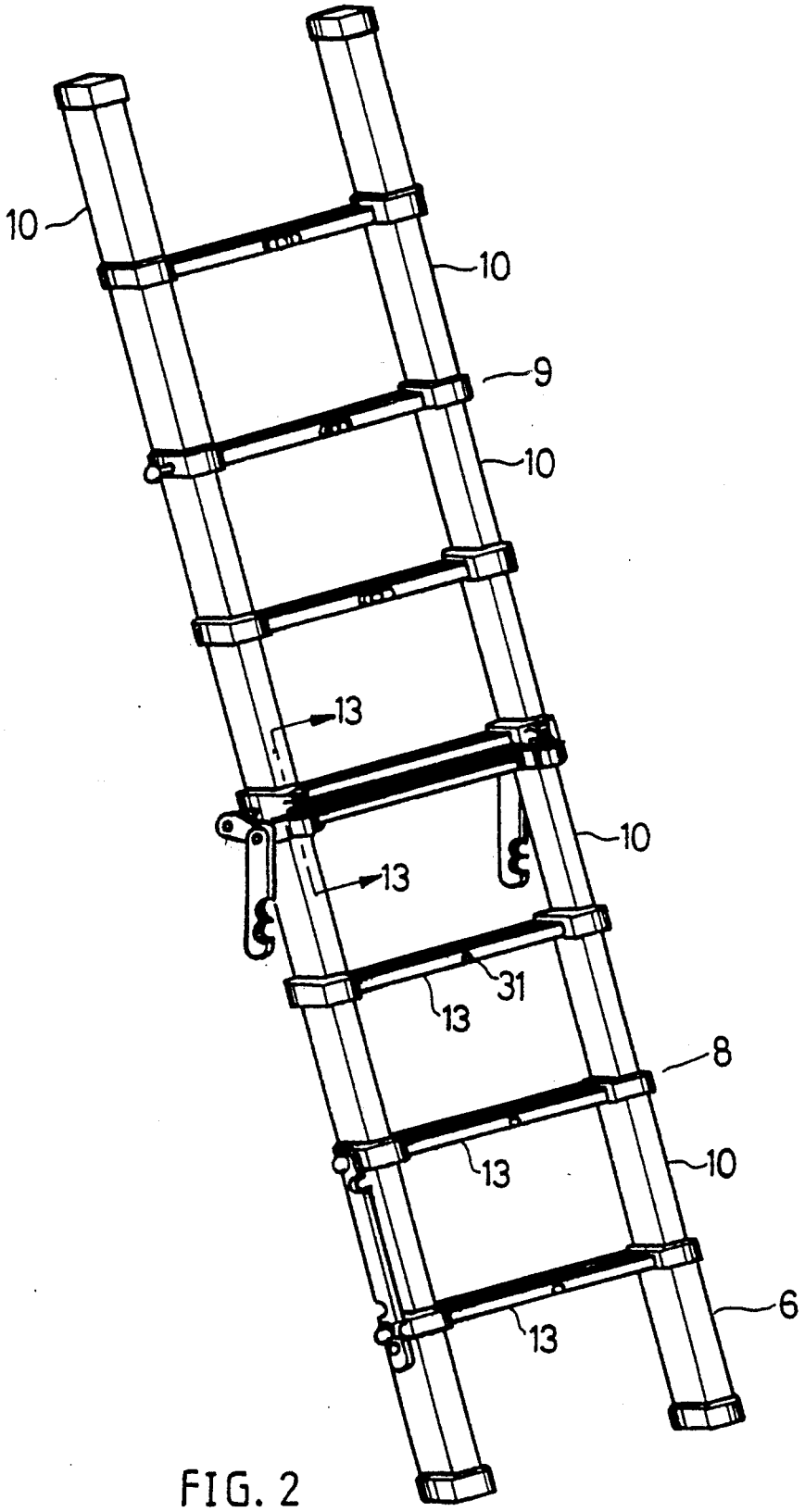
FIG. 2 is a perspective view taken in the same direction as FIG. 1, but showing the ladder in an unfolded "straight" configuration.

Each crossbar 13 (except the upper crossbar) contains a latch mechanism for retaining the four U-shaped support units 6 in their extended conditions (FIG. 1 or FIG. 2). Each latch mechanism comprises two similarly constructed latch pins (elements) 22 extending through guide holes 126 and 123 in guide blocks 28 and plug portions 40 of the associated connector blocks 122. A compressor coil spring 23 normally biases each latch pin 22 outwardly from crossbar 13 toward a latch opening 42 in a side rail 10. Each latch opening 42 is located immediately above an associated plastic sleeve element 21. Latch pins 22 retain the U-shaped support units 6 in their extended positions.

Figure 8:
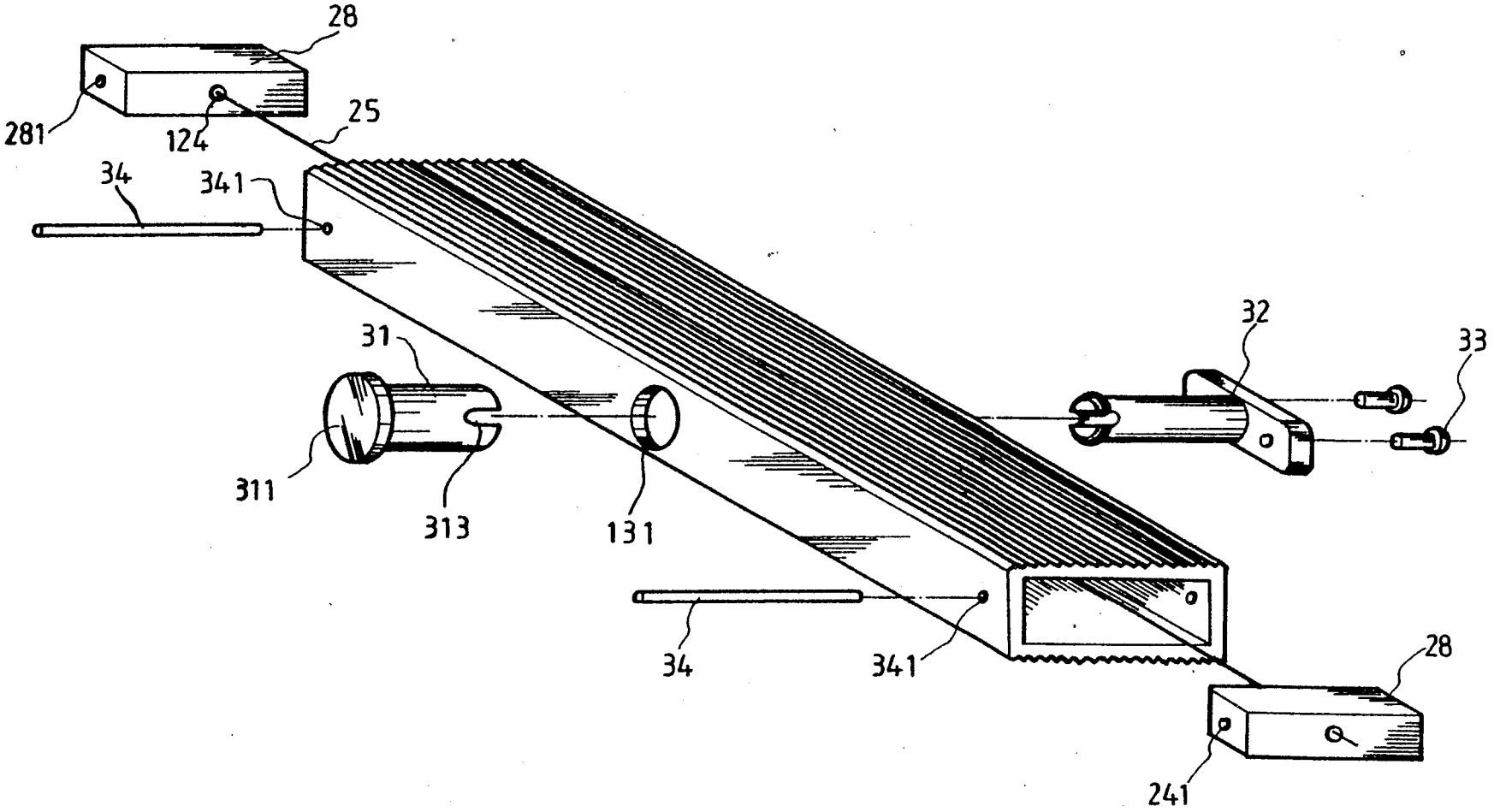
FIG. 8 is an exploded perspective view of a crossbar and associated parts used in the FIG. 1 ladder.
Figure 13:
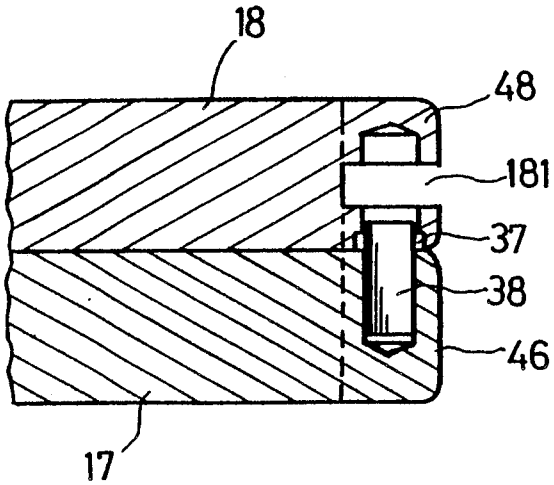
FIG. 13 is a fragmentary perspective view taken on line 13-13 in FIG. 2.
Figure 14:
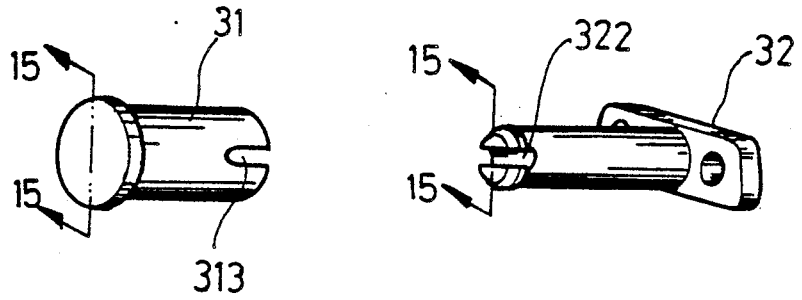
FIG. 14 is an exploded perspective view of a latch operator used in the FIG. 1 ladder.
Figure 15:
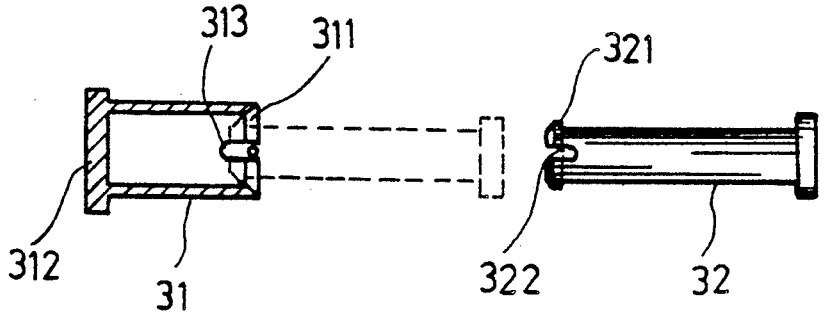
FIG. 15 is a sectional view taken on line 15—15 in FIG. 14.

Each set of latch pins 22 are connected to a flexible rope or thread 25 that extends through slots 322 and 313 in a stationary rod 32 and hollow pushbutton 31 (see FIGS. 8, 14 and 15). Rod 32 is suitably affixed to crossbar 13 at a central point midway between the crossbar ends. Pushbutton 31 is slidably positioned on rod 32, such that manual pressure on exposed surface 311 of the pushbutton causes slots 313 to exert an actuating force on flexible thread 25, thereby retracting latch pins 22 out of openings 42 in side rails 10. When manual pressure is removed from pushbutton 31 coil springs 23 bias the latch pins toward openings 42. As shown in FIG. 15, elements 31 and 32 have lips 311 and 321 for retaining the elements together.

It was noted earlier that ladder sections 8 and 9 have their upper ends hingedly connected by two hinge mechanisms 7 (FIG. 1). Features of the hinge mechanisms are shown in FIGS. 10 through 13. Each hinge mechanism comprises a plastic connector block 17 (FIG. 10) or 18 (FIG. 11) having a socket opening similar to socket opening 122 shown in FIG. 9, whereby the respective block 17 or 18 os affixed to a side rail 10 of the uppermost U-shaped support unit 6. Each block 17 or 18 further includes a laterally extending plug 40 for connecting the respective block to the associated crossbar 13. Each uppermost crossbar 13 is similar to the other three crossbars except that it does not contain a latch mechanism of the type shown in FIGS. 6 and 7.

Each connector block 17 has two integral hinge leaves formed with aligned holes 171. Each connector block 18 has a single integral hinge leave formed with a hole 182 therethrough. A hinge pin 35 is extended through the aligned holes to form a hinge connection between ladder sections 7 and 8.

Figure 10:
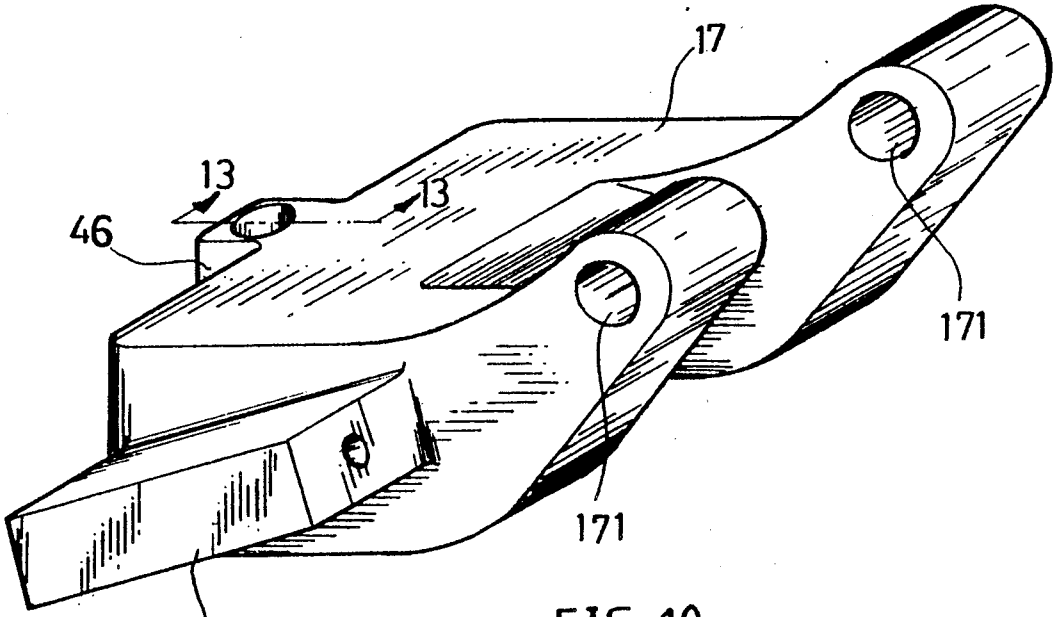
FIG. 10 is a perspective view of a hinge mechanism used in the FIG. 1 ladder.
Figure 12:
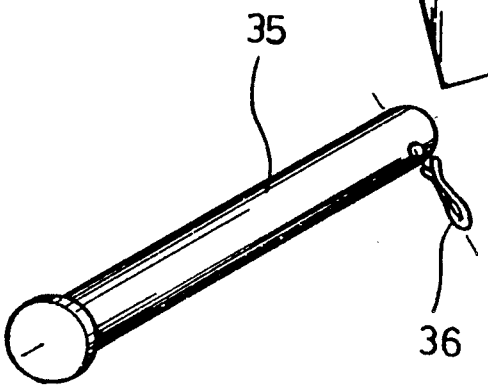
FIG. 12 is a perspective view of a hinge pin used with the hinge mechanisms of FIGS. 10 and 11.

As best seen in FIG. 10, each connector block 17 has an ear 46 extending laterally away from the hinge axis (aligned holes 171). Each connector block 18 has two ears 48 and 50 extending away from the hinge axis. When ladder sections 7 and 8 are swung to the FIG. 2 "straight ladder" configuration each ear 46 will be aligned with ears 48 and 50, as shown generally in FIG. 13. A pin 38 can be inserted obliquely thgrough a clearance space 181 and into aligned openings in ears 50 and 46. A fastener device 37 may be manipulated to affix pin 38 to the aligned ears. The ear-pin system is designed to hold the connector blocks 17 and 18 in their engaged positions (FIG. 13), thereby preventing undesired collapse of the ladder sections out of the "straight ladder" configuration.

Figure 4:
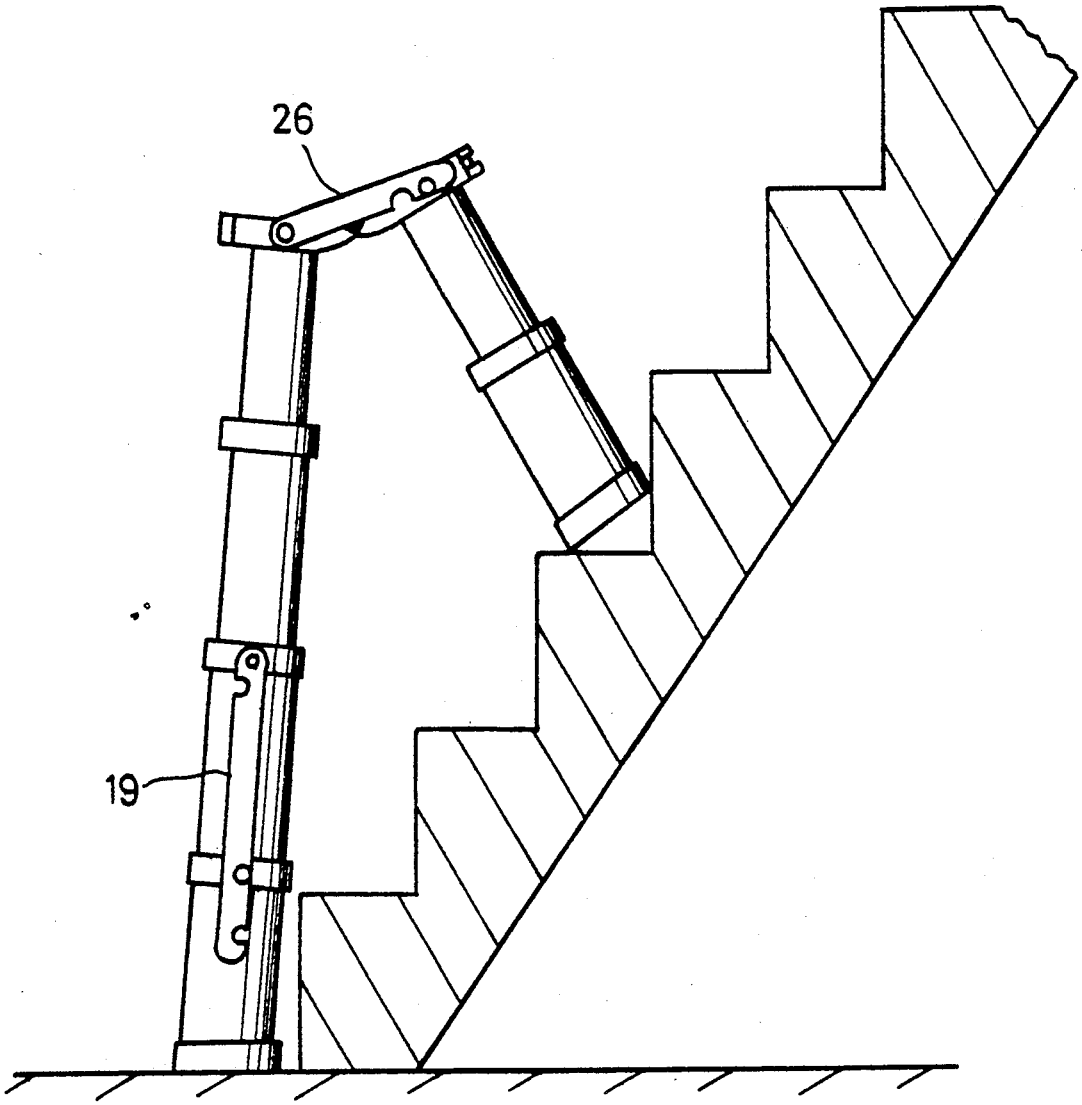
FIG. 4 is a side elevational view of the ladder supported partially on a stairway.
Figure 5:
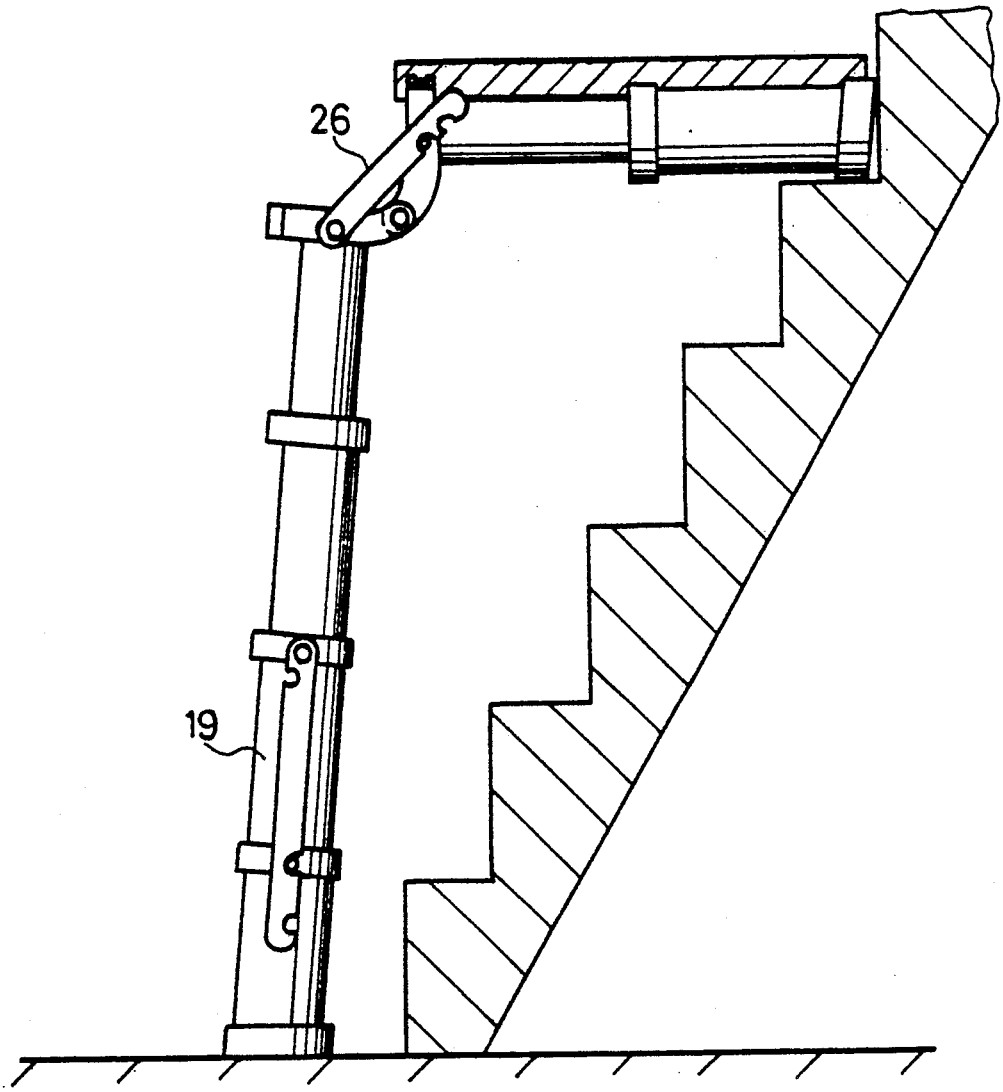
FIG. 5 is a view taken in the same direction as FIG. 4, but showing the ladder in an unfolded condition suitable for supporting a work platform.

The illustrated ladder can be used either in the step ladder configuration of FIG. 1 or the straight ladder configuration of FIG. 2. Additionally the ladder can be folded and retracted into the storage configuration of FIG. 3. FIGS. 4 and 5 show various other configurations that the ladder can take. The ladder can be equipped with swingable tie bars 19 and 26 (FIG. 1) and headed pins 20 for retaining the ladder sections in selected positions of adjustment.

I claim:

1. A collapsible step ladder that can be converted into a straight ladder, comprising two mirror image ladder sections arrangeable in an inverted V-configuration, said ladder sections having upper ends thereof in near proximity to each other and lower ends thereof spaced apart to define a V-configuration; hinge means connecting the upper ends of said ladder section, whereby the two ladder sections can be collapsed together or reoriented into a straight line configuration for use as a straight ladder;

each ladder section comprising an upper U-shaped unit and a plural number of other U-shaped units having side rails thereof telescopically interconnected for contraction or extension of the U-shaped units;

each said other U-shaped unit comprising two spaced parallel tubular side rails having upper ends and lower ends, a plastic sleeve element affixed to the lower end of each side rail, a plastic connector block affixed to the upper end of each side rail, and a hollow foot-engageable cross bar having opposite ends thereof attached to said connection blocks on the associated side rails;

each connector block having a relatively large socket opening (122) therein encircling the upper end of the associated side rail, a relatively small guide bore (121) extending upwardly from said socket opening, a laterally-extending plug inserted into the end of the associated hollow cross bar, and a guide hole extending through said plug between the hollow bar interior space and the side rail interior space;

said U-shaped units being telescopically interconnected so that each side rail of a given unit has a slidable fit in a guide bore (121) of the next lowermost unit, and each plastic sleeve element has a slidable fit in the side rail of the next lowermost unit;

at least some of said side rails having latch openings therein located immediately above the associated plastic sleeve elements, slidable latch elements extending through said guide holes for insertion into latch openings in the associated side rails when the U-shaped units are in their extended positions, and manually-operable push button operators centrally mounted in selected ones of the cross bars for retracting the latch elements from the associated latch openings.

2. The collapsible step ladder of claim 1, wherein each upper U-shaped unit comprises two spaced parallel tubular side rails, an additional foot-engageable cross bar, and two additional plastic connector blocks affixed to the upper ends of the associated side rails;

each additional block having a socket opening encircling the upper end of the associated side rail, a laterally-extending plug inserted into an end of the associated cross bar, at least one hinge leaf, and at least one fastener ear;

said fastener ears on different ones of said additional connector blocks being aligned when the two ladder sections are oriented into a straight line configuration for use as a straight ladder.

* * * * *